US006505770B1

(12) United States Patent
Correa, Jr.

(10) Patent No.: US 6,505,770 B1
(45) Date of Patent: Jan. 14, 2003

(54) OUTGOING AND REPLY ENVELOPES WITH IMPROVEMENTS TO REDUCE POSSIBILITY OF DAMAGE

(76) Inventor: Manuel A. Correa, Jr., 3617 Toddsbury La., Olney, MD (US) 20832

( * ) Notice: Subject to any disclaimer, the term of this patent is extended or adjusted under 35 U.S.C. 154(b) by 0 days.

(21) Appl. No.: 09/579,495

(22) Filed: May 30, 2000

(51) Int. Cl.[7] ..... B65D 27/06; B65D 65/28; B65D 65/32

(52) U.S. Cl. ..... 229/301; 229/316

(58) Field of Search ..... 229/301, 305, 229/313, 316

(56) References Cited

U.S. PATENT DOCUMENTS

| | | | | | |
|---|---|---|---|---|---|
| 3,650,463 | A | * | 3/1972 | Christiansen et al. | 229/313 |
| 3,988,971 | A | | 11/1976 | Steidinger | |
| 4,081,127 | A | | 3/1978 | Steidinger | |
| 4,095,695 | A | | 6/1978 | Steidinger | |
| 4,157,759 | A | * | 6/1979 | Dicker | 229/313 |
| 4,166,539 | A | * | 9/1979 | Allen et al. | 229/313 |
| RE30,114 | E | * | 10/1979 | Juszak et al. | 229/69 |
| 4,212,396 | A | * | 7/1980 | Allen et al. | 229/313 |
| 4,425,386 | A | | 1/1984 | Chang | |
| 4,586,611 | A | * | 5/1986 | Scalzo | 229/313 |
| 4,775,094 | A | * | 10/1988 | Eisele | 229/313 |
| 4,819,807 | A | * | 4/1989 | Giger | 229/313 |
| 4,934,536 | A | * | 6/1990 | Mills | 229/313 |
| 4,955,526 | A | * | 9/1990 | Haase et al. | 229/313 |
| 5,039,000 | A | * | 8/1991 | Ashby | 229/313 |
| 5,282,568 | A | * | 2/1994 | File | 229/303 |
| 5,324,927 | A | | 6/1994 | Williams | |
| 5,341,985 | A | * | 8/1994 | Peterson | 229/305 |

FOREIGN PATENT DOCUMENTS

| | | | | |
|---|---|---|---|---|
| CH | 664941 | * | 4/1988 | 229/313 |

* cited by examiner

*Primary Examiner*—Stephen P. Garbe
(74) *Attorney, Agent, or Firm*—William D. Hall

(57) ABSTRACT

A postal envelope system has an outgoing envelope containing a billing statement and a reply envelope. The reply envelope has a flap for closing the envelope. The outgoing envelope has a tab for opening it. The tab has a portion which is held and pulled in order to open the envelope. The flap of the return envelope and a small portion of the billing statement is directly under the tab of the outgoing envelope. The flap and the billing statement are positioned and have a shape, which keeps them outside of the paths of a finger and thumb that are moving into a position for grasping said tab portion so that the billing statement and flap are not grabbed and pulled along with the tab portion and tab.

16 Claims, 15 Drawing Sheets

Part VI Back

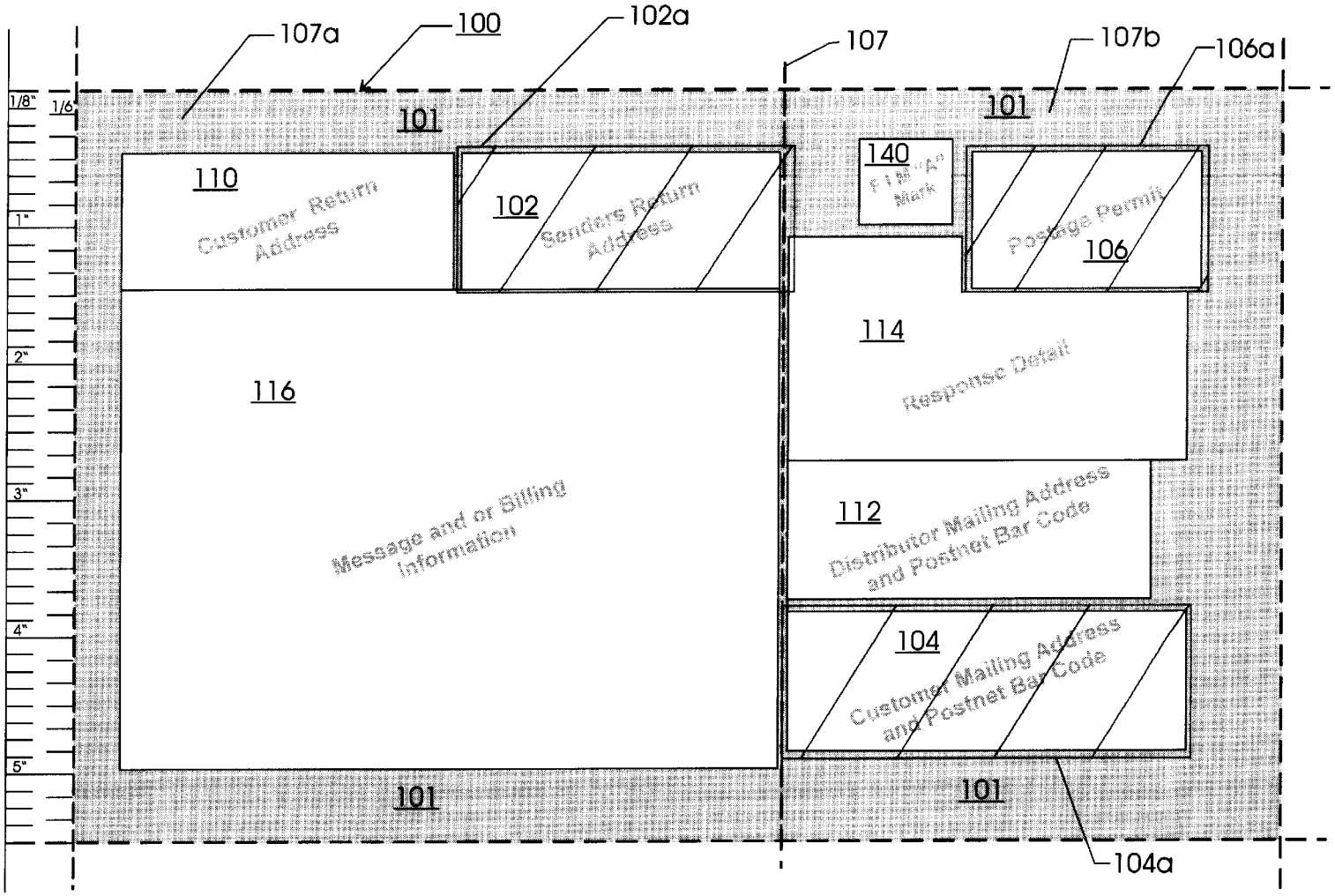
FIG. 2, Part I

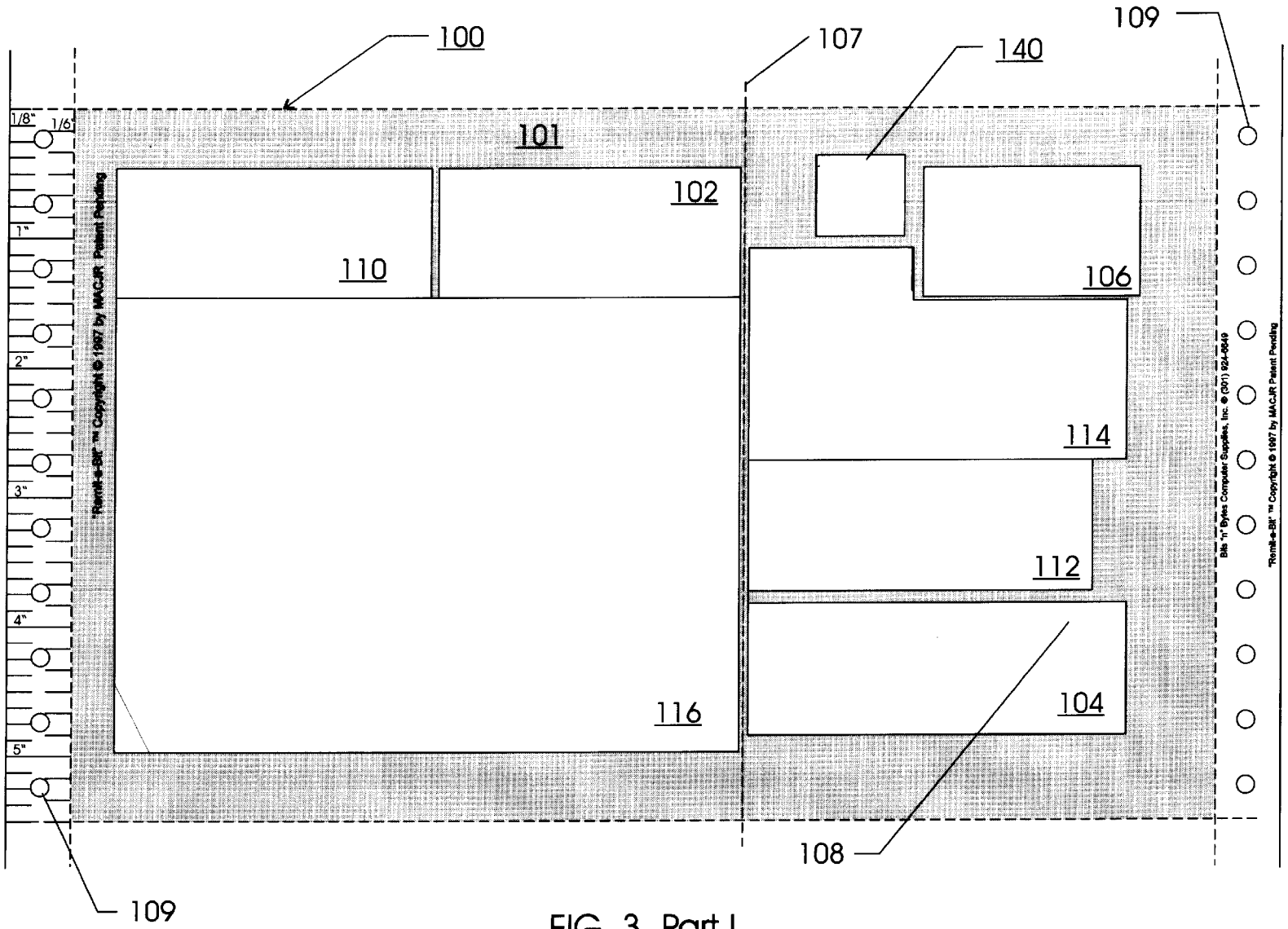
FIG. 3, Part I

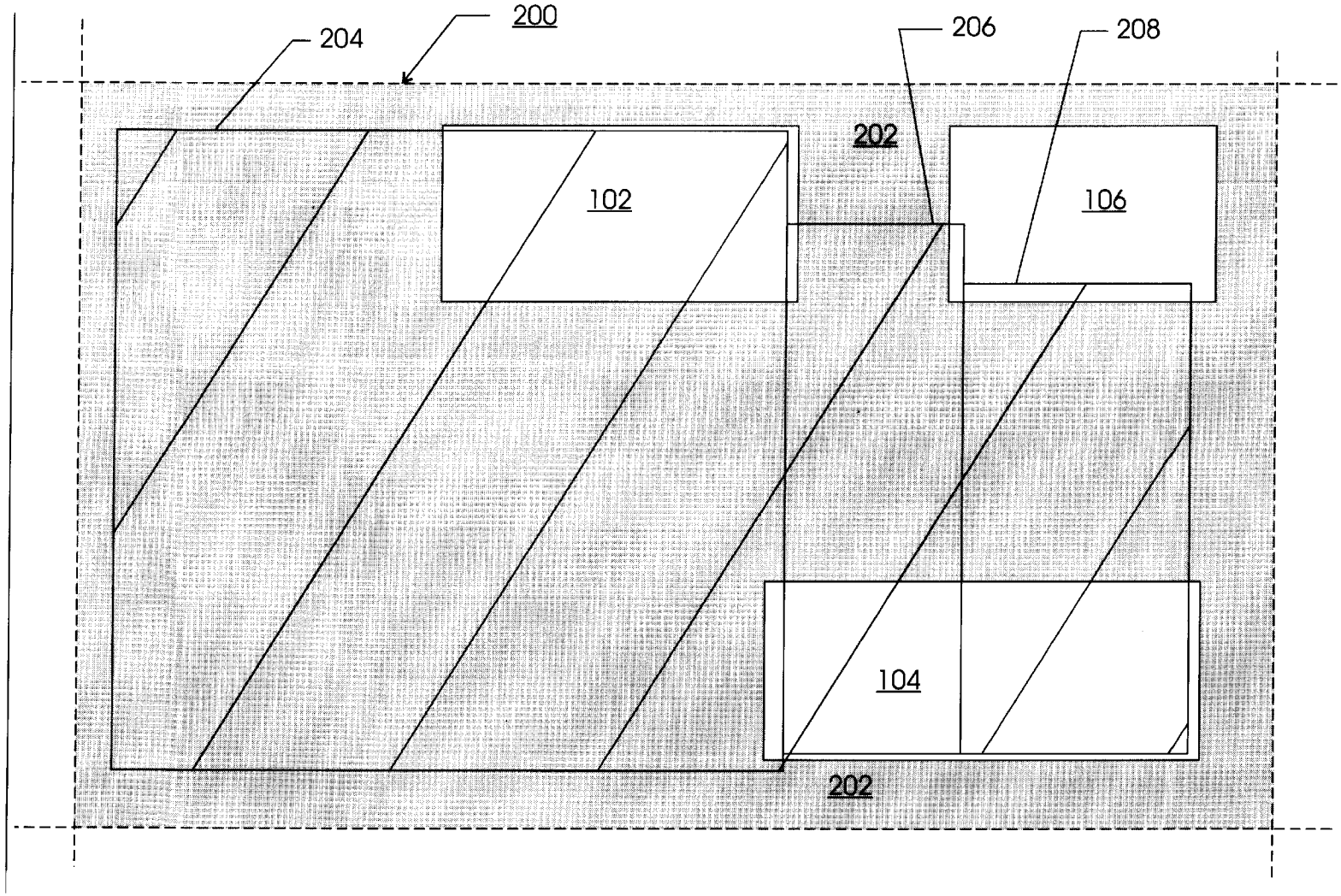
FIG. 4, Part II

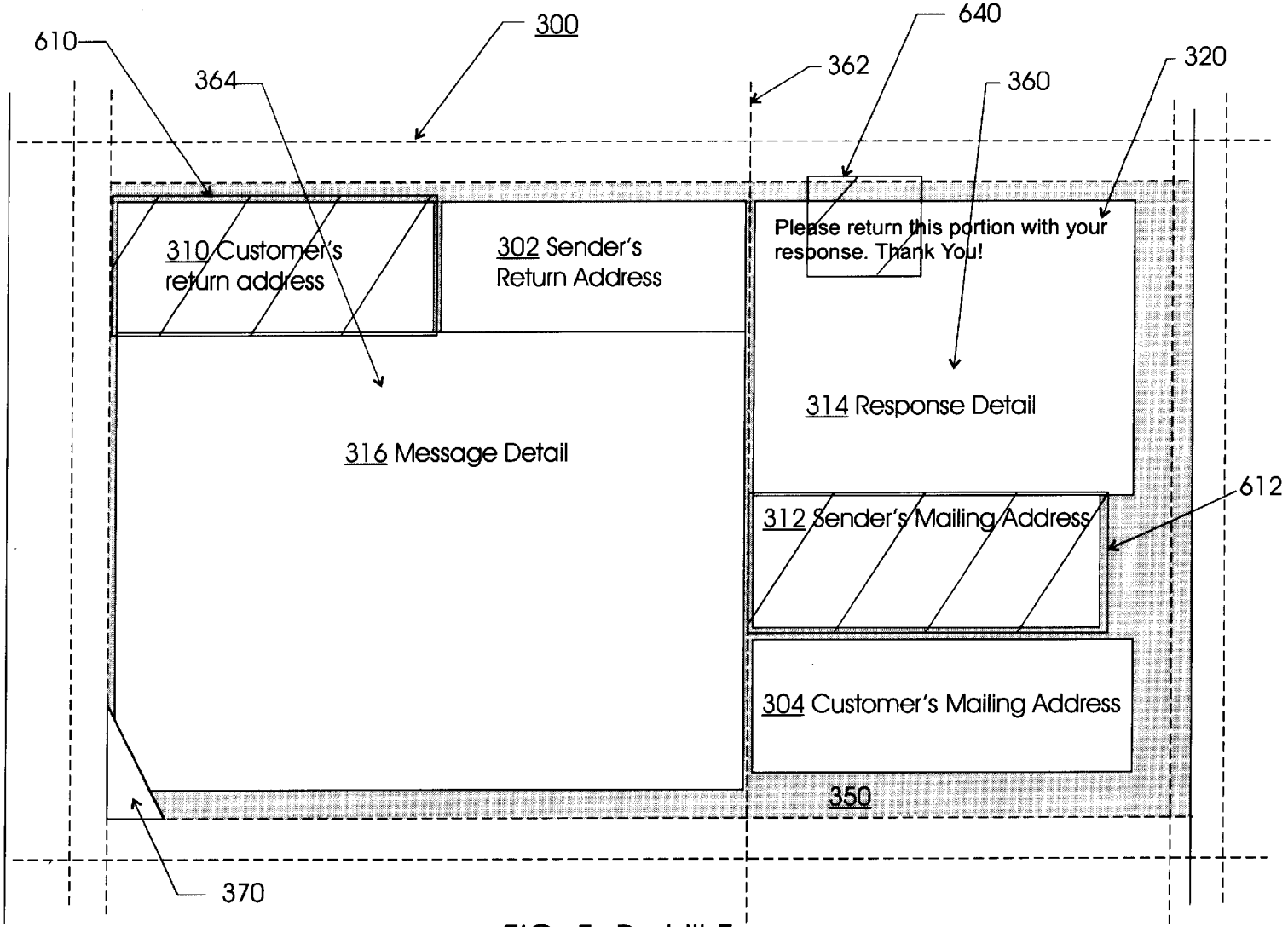
FIG. 5, Part III Face

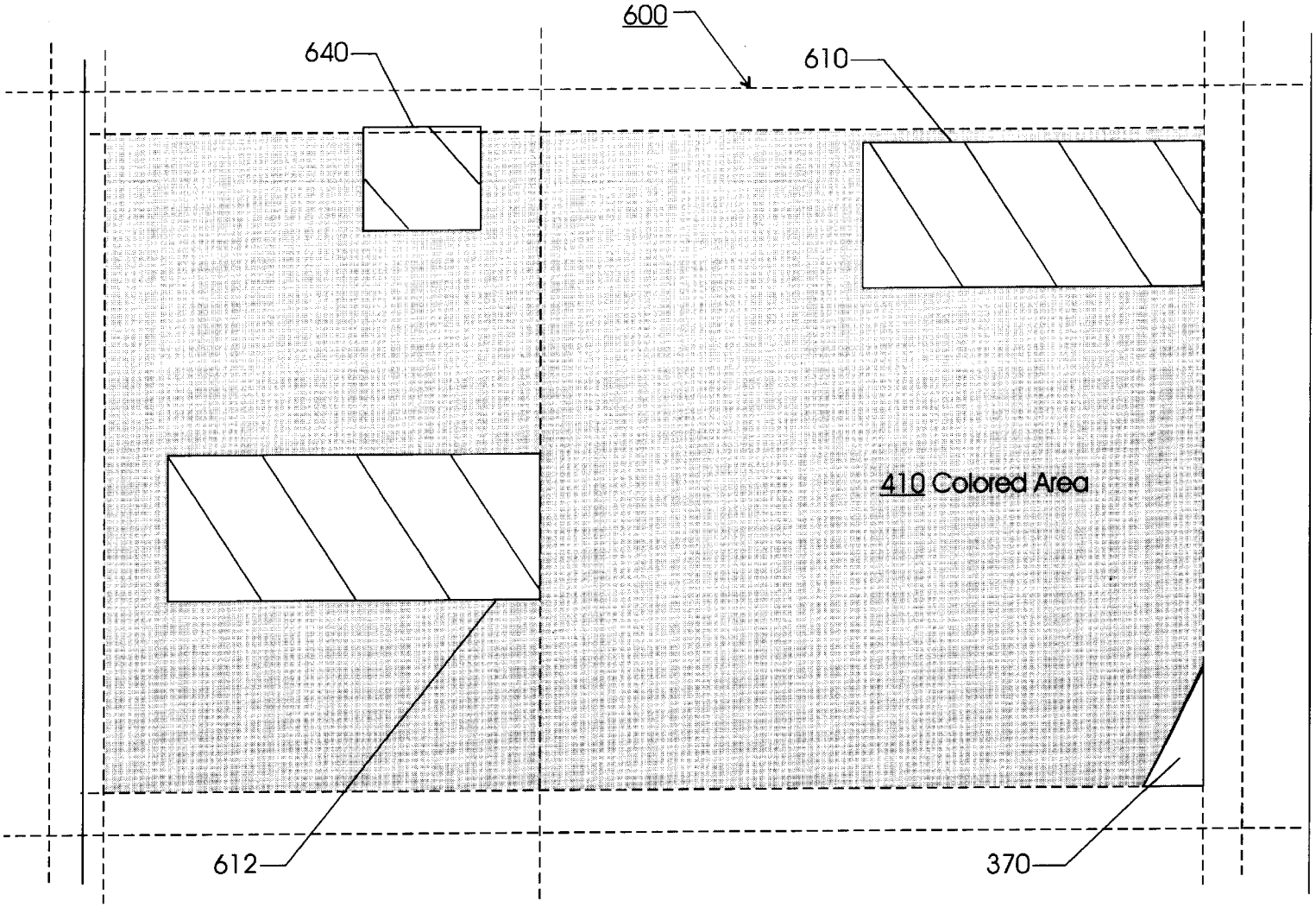
FIG. 6, Part III Back

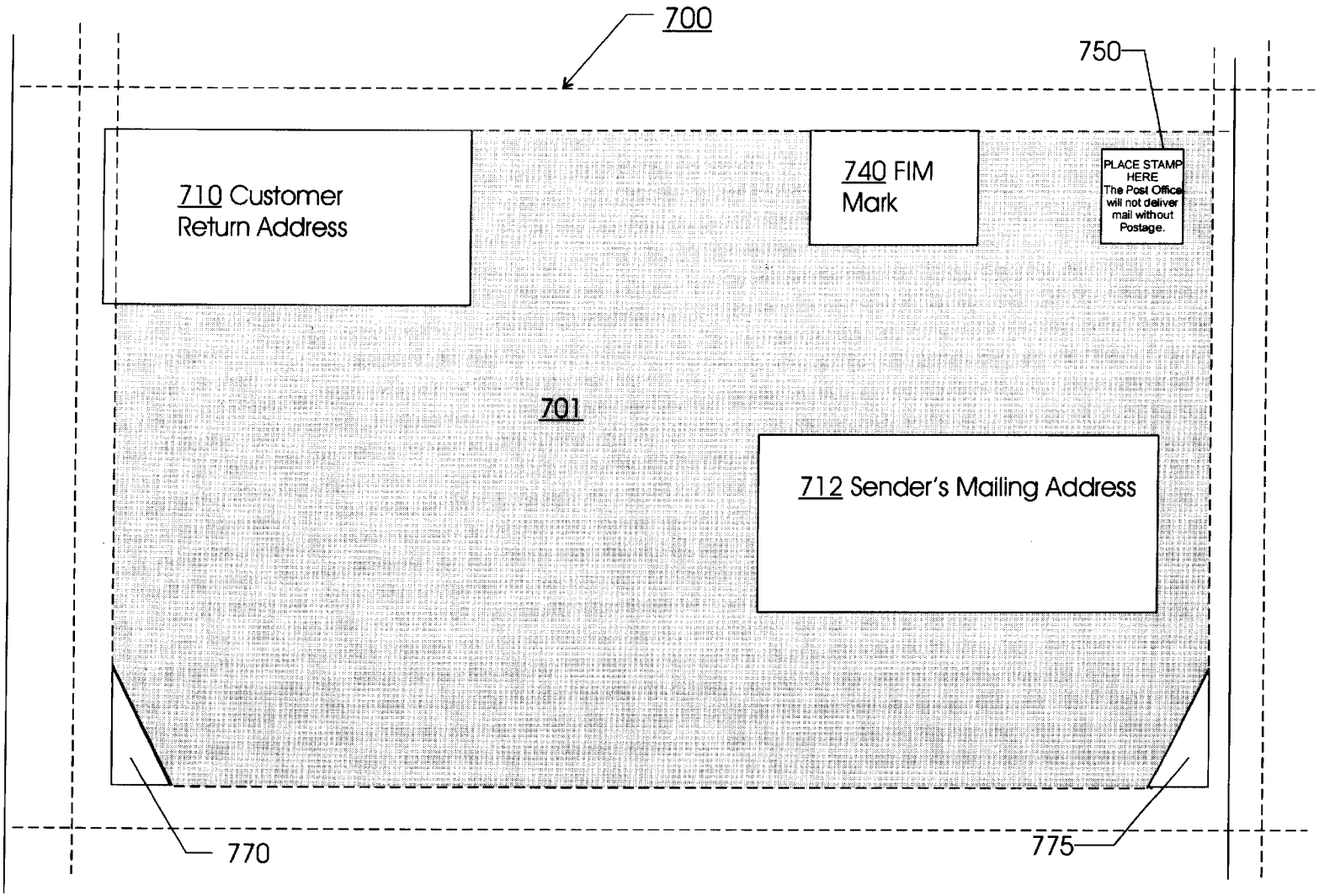
FIG. 7, Part IV Face

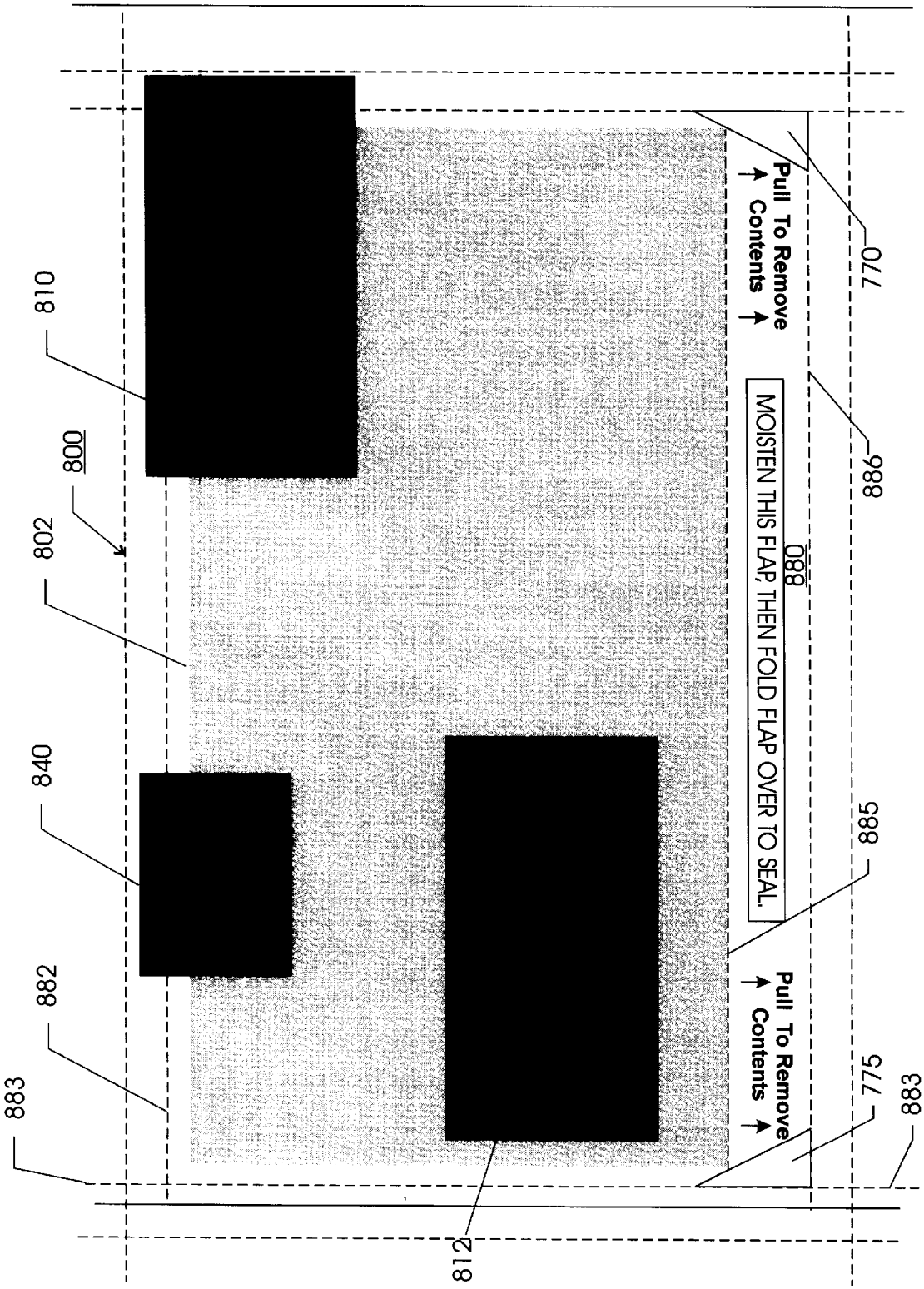
FIG. 8, Part IV Back

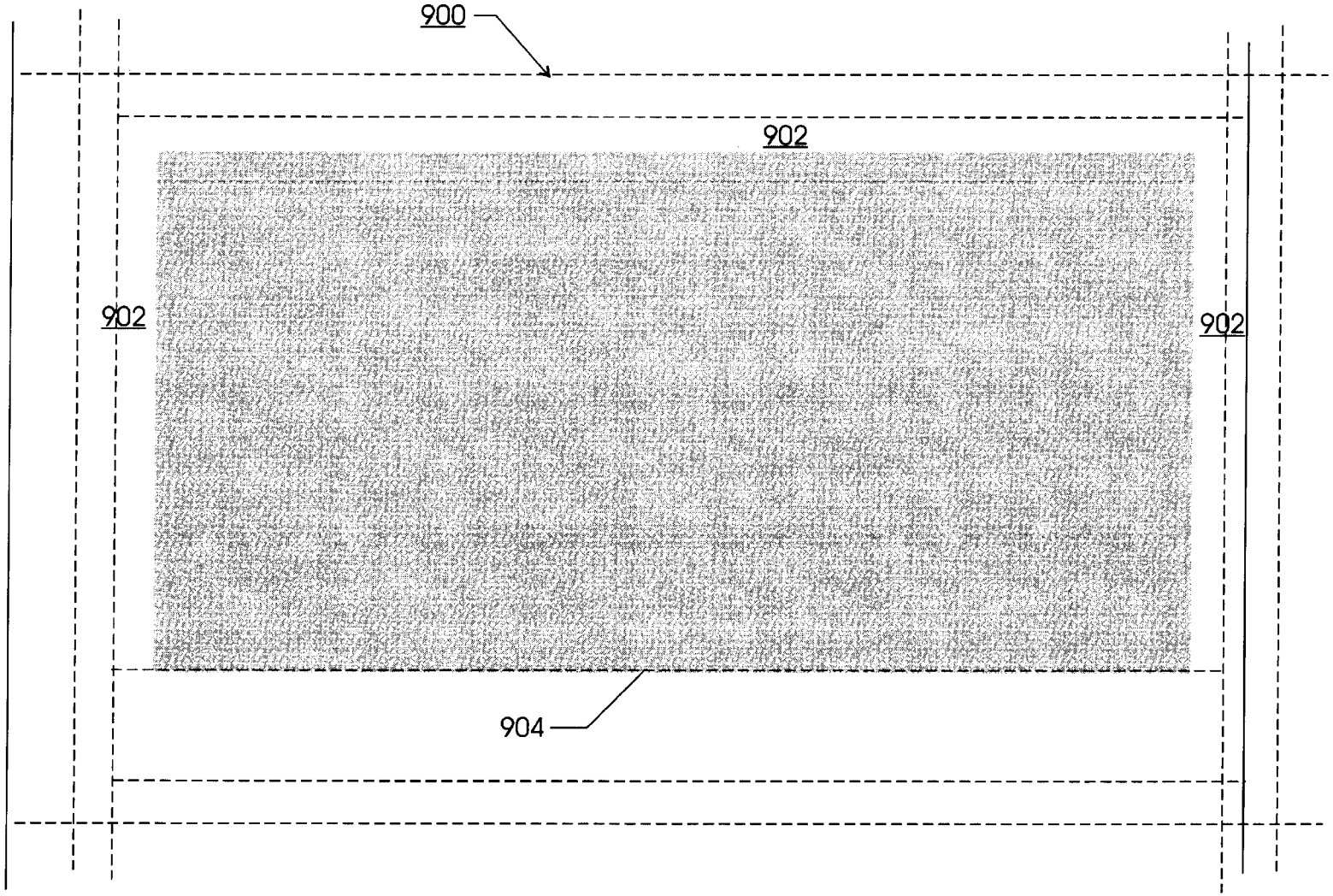
FIG. 9, Part V Face

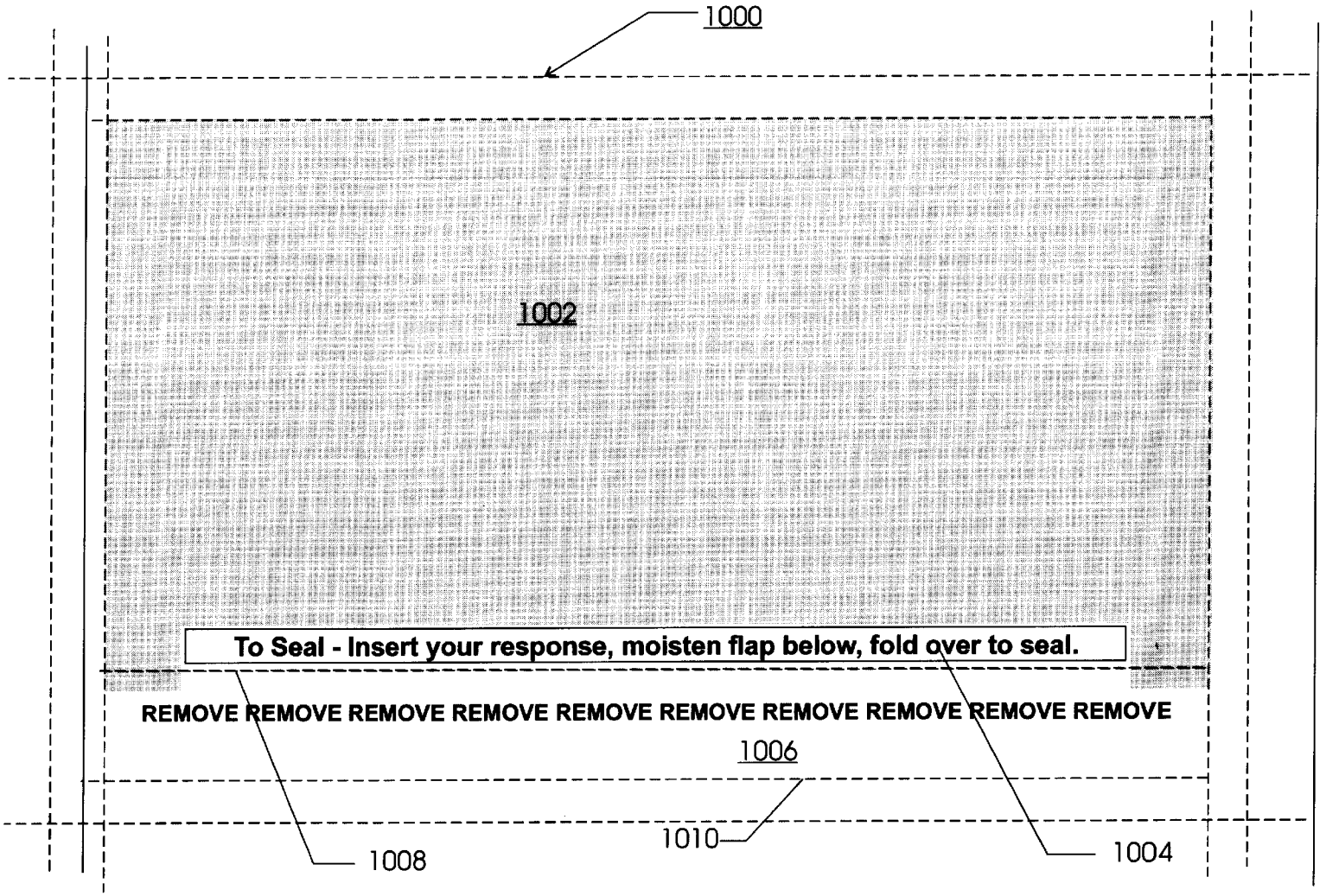
FIG. 10, Part V Back

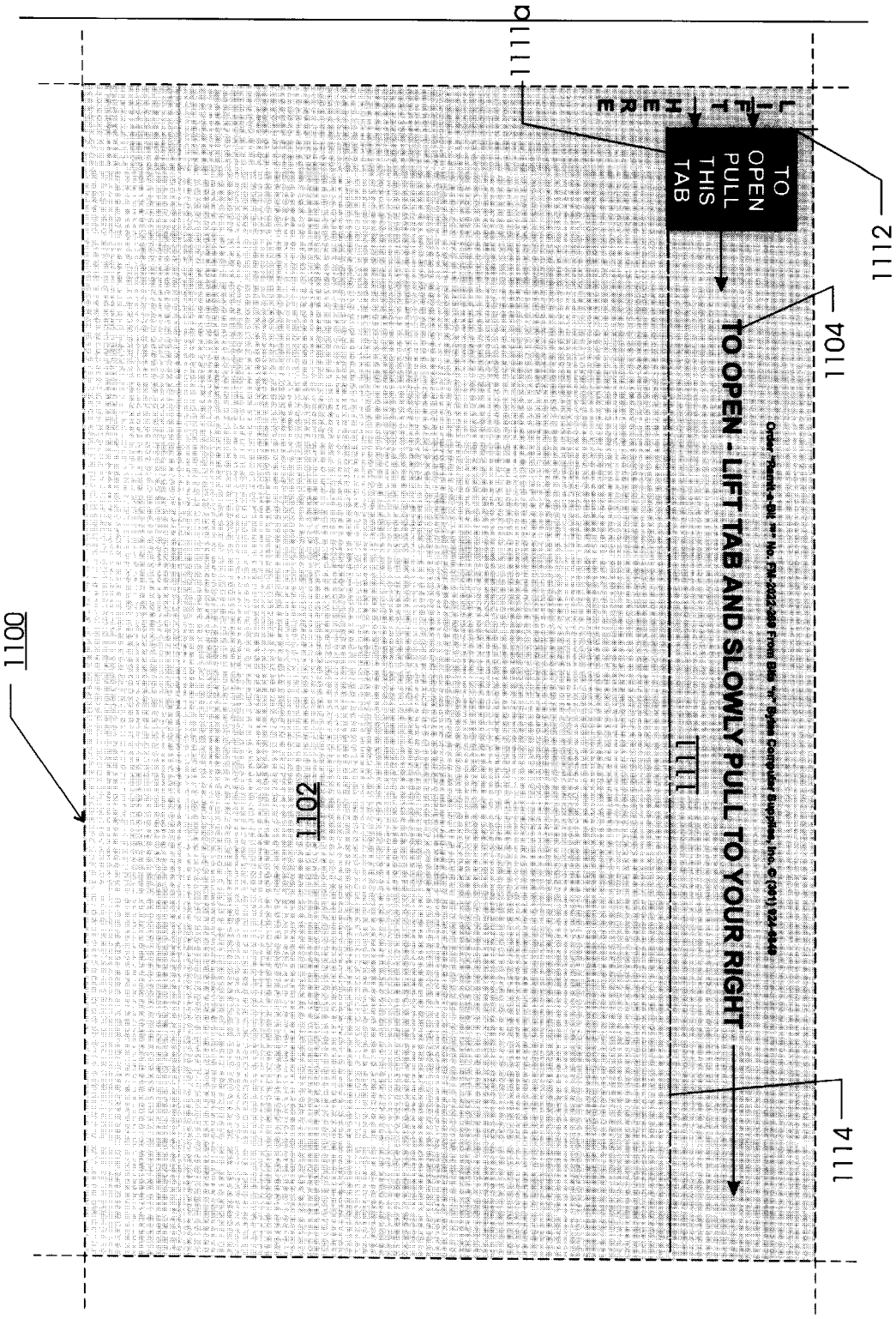
FIG. 11, Part VI Back

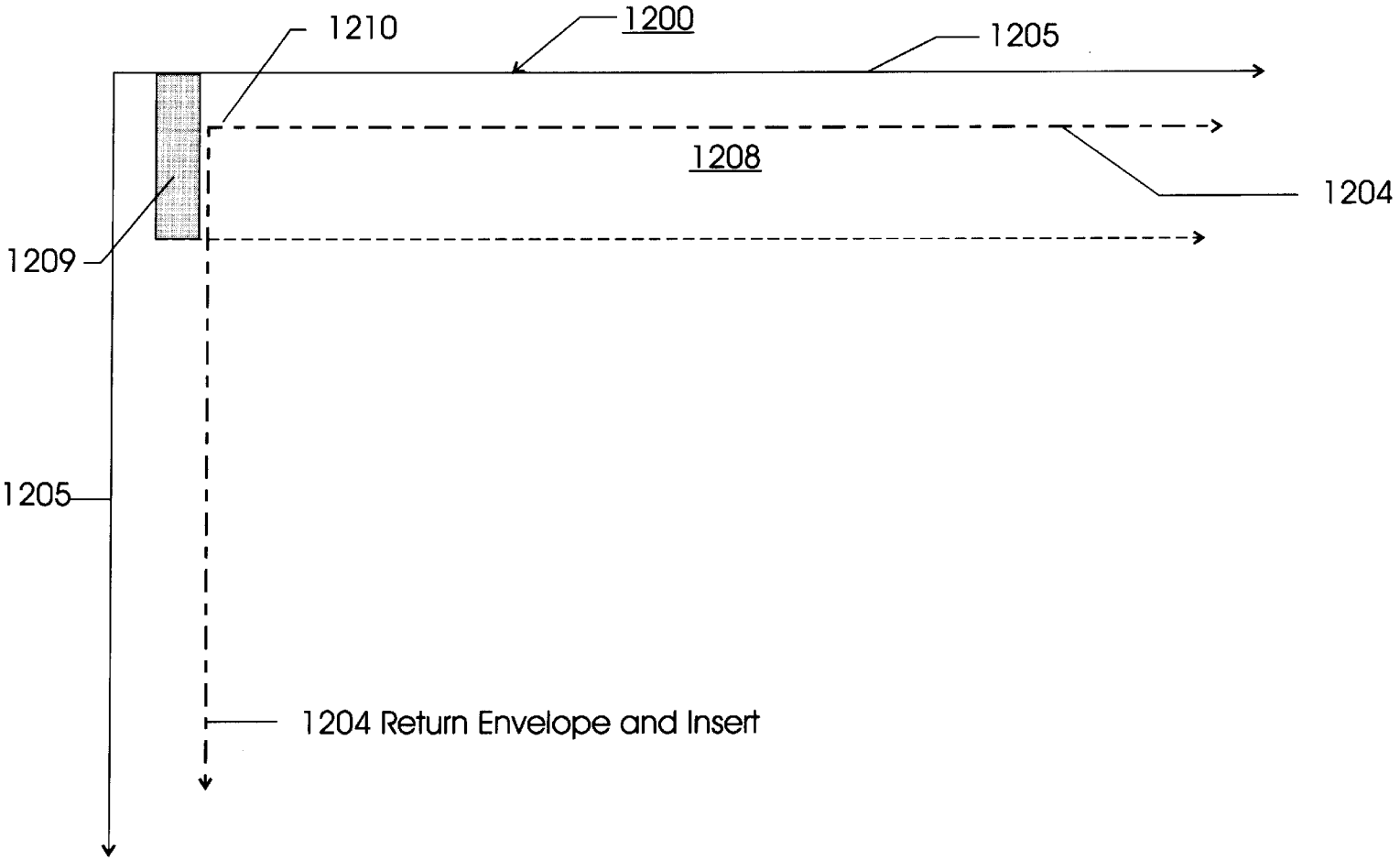
FIG. 12, Part VI Back

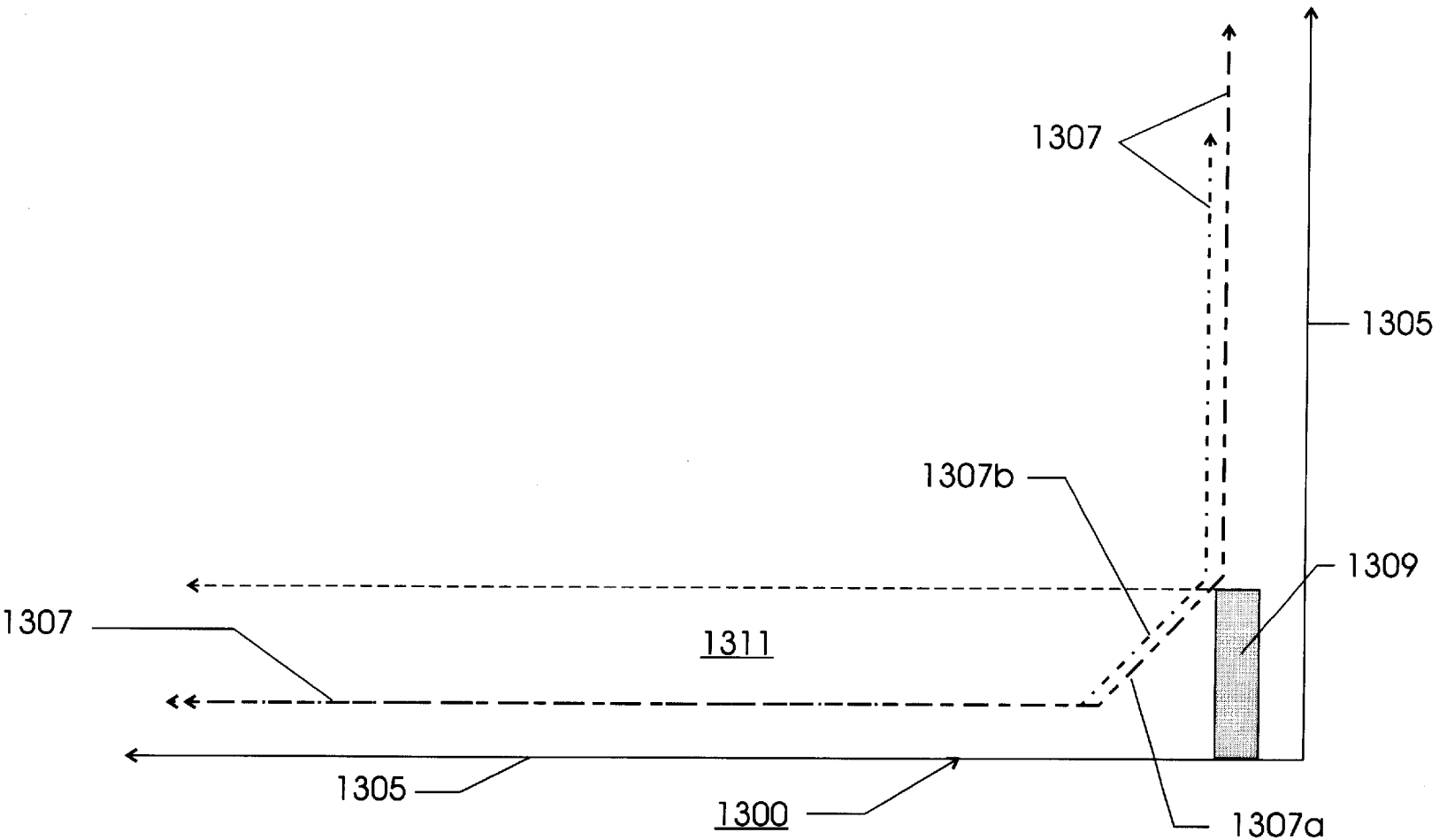
FIG. 13, Part VI Back

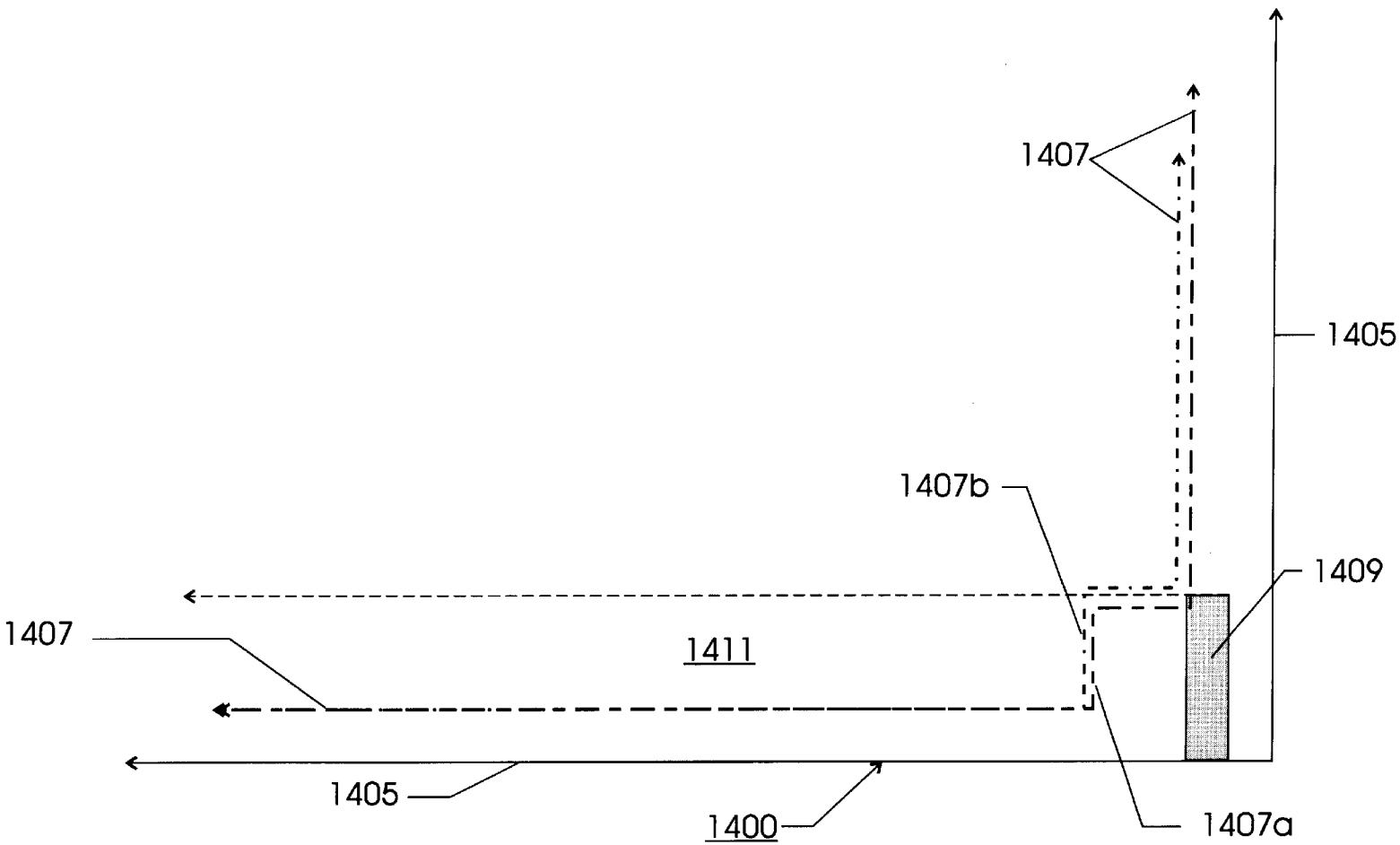
FIG. 14, Part VI Back

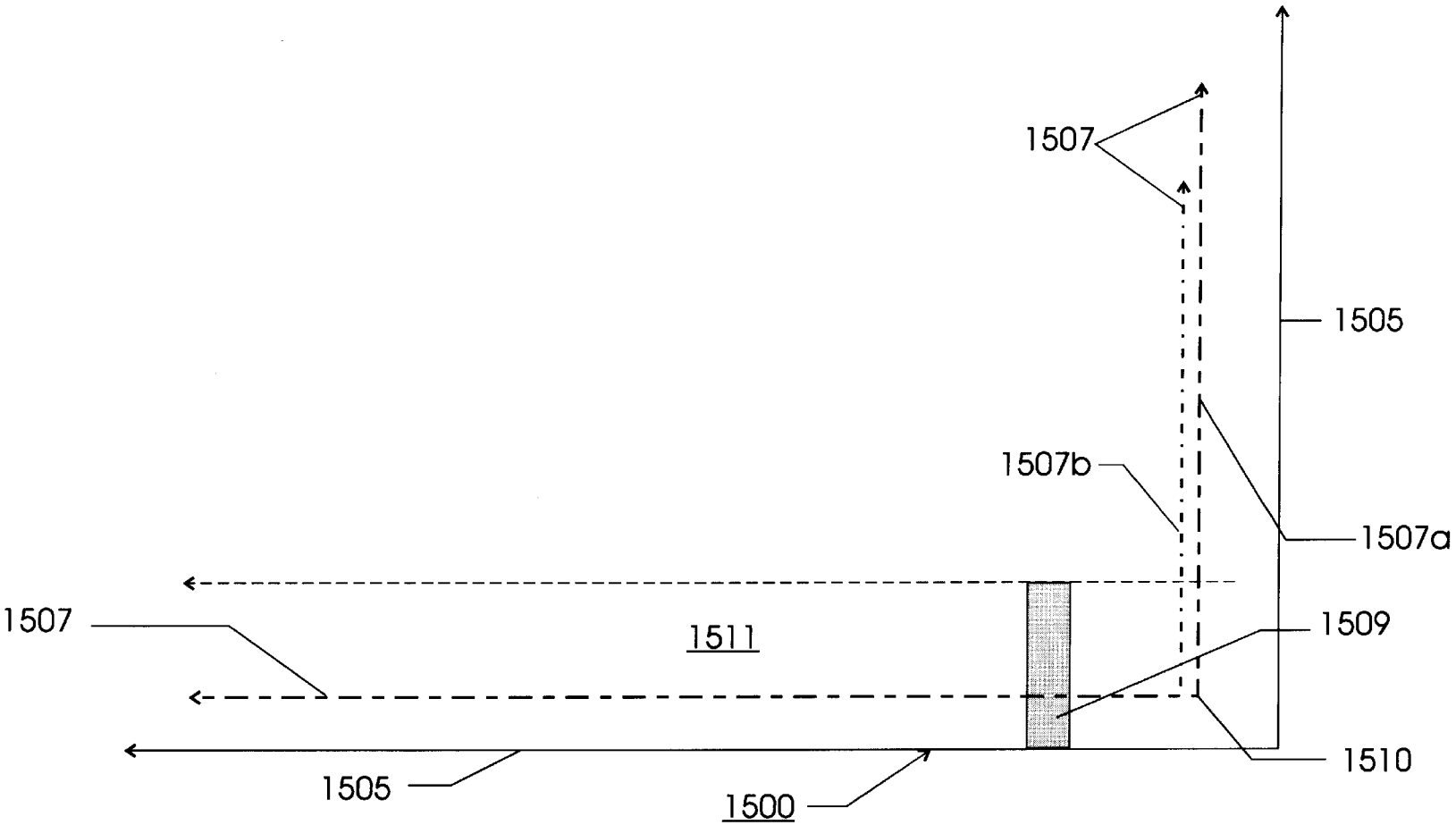
FIG. 15, Part VI Back

OUTGOING AND REPLY ENVELOPES WITH IMPROVEMENTS TO REDUCE POSSIBILITY OF DAMAGE

BACKGROUND OF THE INVENTION

This invention relates to envelope systems such are widely used for the purpose of billing customers. Such systems have an outgoing envelope with a reply envelope and a bill located in the outgoing envelope. When the customer receives the outgoing envelope, he or she opens it, removes the reply envelope and bill, tears the bill along a tear line into two pieces, inserts one of those pieces along with his or her check in the reply envelope and mails the reply envelope.

By using impact printing and certain carbonized areas, addresses may be printed on the envelopes, and billing information on the billing statement.

For years prior to my invention, Transkrit Corp., of Roanoke, Va. sold an envelope system along the lines taught in its U.S. Pat. No. 4,157,759. That patent teaches an outgoing envelope 20, having a removable tab portion 15, along the top edge of the back side of the envelope. The reply envelope (FIG. 7) is inside of the outgoing envelope 20 with a flap 28 directly underneath the tab 28 of the outgoing envelope 20, when the envelope system is viewed from the rear.

My copending application Ser. No. 09/328,417, filed Jun. 9, 1999 and entitled POSTAL OUTGOING AND REPLY ENVELOPE SYSTEM shows an envelope system. That application teaches an envelope system in which the tab, for opening the outgoing envelope, and the flap, for sealing the reply envelope, and the bill are all adjacent the bottom edge of the envelope system as viewed from the rear side thereof.

The above-mentioned envelope systems have a disadvantage in that a customer who has not previously used the system, or who is in a hurry to open the outgoing envelope may, when he or she hurriedly grabs the tab on the outgoing envelope may also grab the flap, or other portion of the underlying reply envelope. In such case when the customer rips open the tab of the outgoing envelope he or she at the same time damages the reply envelope and bill.

Only a short portion of the tab 28, usually at one end of the tab is pinched by a human hand and pulled to open the envelope. It is the portion of the billing sheet, or the portion of the flap 28 that is vertically below said portion which can be accidentally grabbed during the opening of the outgoing envelope.

SUMMARY OF THE INVENTION

The above problem is solved by the present invention. The flap on the reply envelope is formed from a sheet of paper which sheet becomes the rear wall of the reply envelope. By reshaping said sheet, and by reshaping the bill, the probability that an inexperienced person will damage the reply envelope and bill when he, or she, opens the outgoing one is greatly reduced.

The reshaping of said sheet and the bill involves reducing the size of those parts that lie directly under the portion of the tab that is held by the human hand while the tab is being pulled to open the outgoing envelope. Alternatively, the flap and billing statement may be reshaped to eliminate entirely any part of the flap and billing statement that is underneath said portion.

Normally, when a person desires to open the outgoing envelope he or she moves a finger and thumb (which are parts of a hand) in a path so that the finger is on one side and the thumb on the other side of the portion of the tab that is adapted to be pinched or held by a human hand. Following the pinching, the person pulls on the tab portion and rips the tab off of the outgoing envelope.

According to this invention, any billing statement and any flap on the return envelope are of such shape and position that they are outside of any path that a finger and thumb might take when the finger and thumb are moved to the pinching position.

BRIEF DESCRIPTION OF THE DRAWINGS

Reference is made to the attached drawings, wherein elements having the same reference numeral designations represent like elements throughout.

FIG. 2 is a block diagram of Part I which forms an originating sheet of the postal envelope form system of the present invention, and depicts a front face having colored areas and white areas, and shows carbon spots of a back face in cross-hatching.

FIG. 3 is an actual copy of the front face of Part I, and depicts placement of text within the various blocks shown in FIG. 2.

FIG. 4 is a block diagram of a front face of Part II, which forms a portion of an outgoing envelope of the postal envelope form system of the present invention, and depicts colored and white areas on the front face, and shows carbon spots of a back face in cross-hatching.

FIG. 5 is a block diagram of a front face of Part III, which forms a billing statement of the postal envelope form system of the present invention, and depicts colored areas and white areas.

FIG. 6 is a block diagram of a back face sheet of Part III of the billing statement shown in FIG. 5, and depicts colored areas, and shows a front view of carbon spots in patterned cross-hatching.

FIG. 7 is a block diagram of a front face of Part IV, which forms a portion of a reply envelope of the postal envelope form system of the present invention, and depicts colored areas and white areas which are a mirror image of carbon spots shown in FIG. 6.

FIG. 8 is a block diagram of a back face of Part IV, which forms the same portion of the reply envelope shown in mirror image of FIG. 7, and depicts security screened areas, and shows block-out areas in solid dark blocks.

FIG. 9 is a block diagram of a front face Part V of the back of the reply envelope, and depicts a security screened area.

FIG. 10 is a block diagram of a back face of Part V, which is the outside of another portion forming the reply envelope, and depicts colored areas and printed directions.

FIG. 11 is a block diagram of a back face of Part VI, which is the outside of another portion of outgoing envelope shown in FIG. 4, and depicts colored areas, directions and a fast pull tab for opening.

FIG. 12 is a detailed view of the back side of a prior art outgoing envelope.

FIG. 13 is a detailed view of the back side of an envelope of my present invention showing the relationship of the tab for opening the outgoing envelope, the flap of the reply envelope and the billing statement.

FIG. 14 is a view similar to that of FIG. 14 except it shows a modified form of the invention.

FIG. 15 is a view similar to FIGS. 14 and 15 except it shows another modified view of my invention.

DETAILED DESCRIPTION OF THE INVENTION

Figure 1:
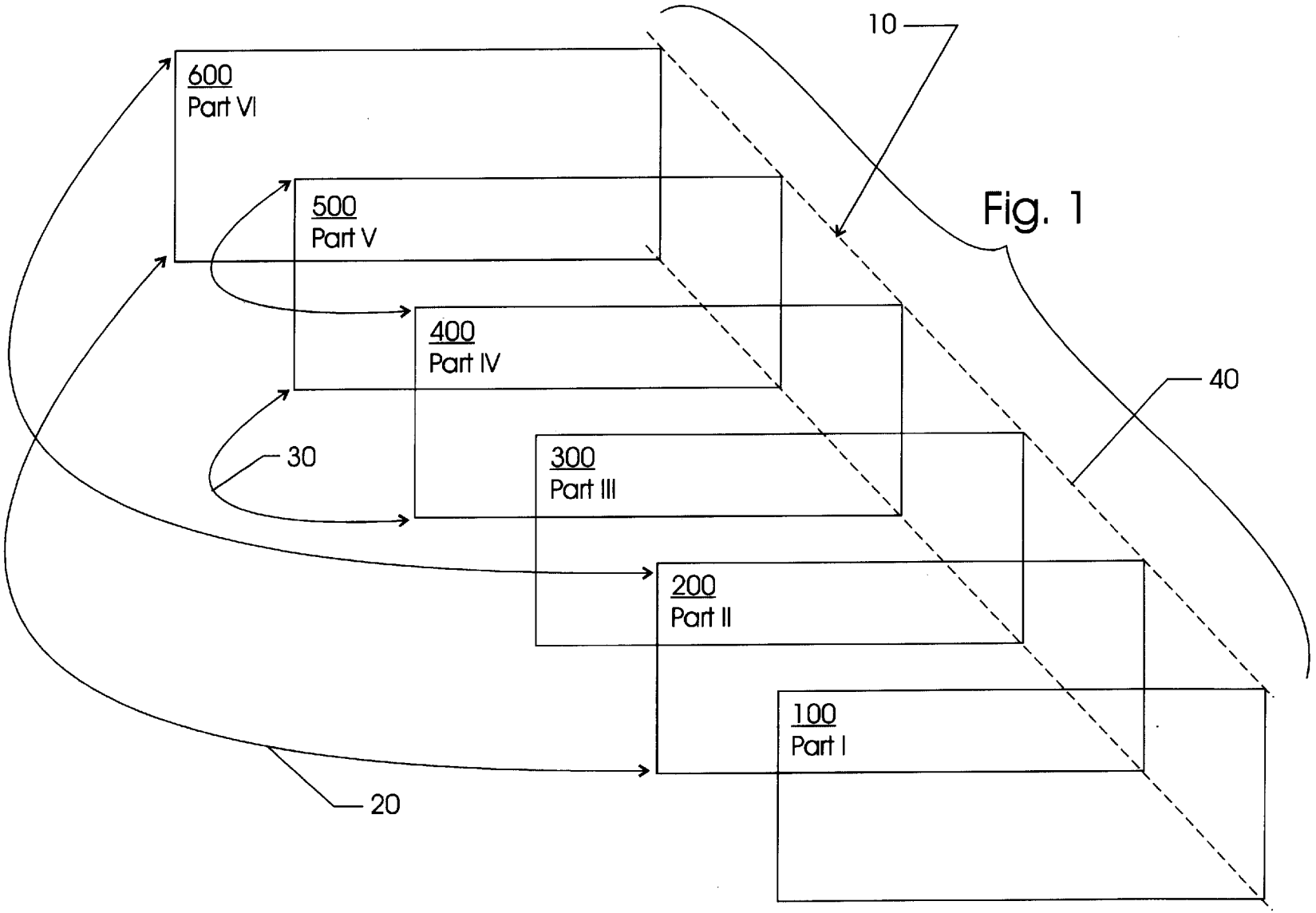
FIG. 1 is a perspective view of a postal envelope form system, and depicts several parts that are attached together to form an embodiment of the present invention.

FIG. 1 is a perspective view of a postal envelope form system 10. System 10 comprises several sheets or parts that are attached together to form an embodiment of the present invention. System 10 is to be used as a self-mailer system where an outgoing envelope is mailed to a customer along with bill information and a reply envelope is to be used to return payment or payment information in exchange for goods or services rendered.

The several sheets shown in FIG. 1 include a Part I 100 which is attached to a Part II 200, which is attached to a Part III 300, which is attached to a Part IV 400, which is attached to a Part V 500, which is in turn attached to a Part VI 600. Part I 100, Part II 200, Part III 300, Part IV 400, Part V 500, and Part VI 600 are attached on right side edge 40 in order to strengthen portions of system 10 that undergo postal processing by processing equipment used in delivery of mail.

Part I 100 is formed from a sheet of twelve-and-a-half pound selectively carbonized bond paper. The twelve-and-a-half pound designation is commonly understood in the paper and forms-processing industry as corresponding to the weight of 1000 sheets of a specific size of paper. The selective carbonization is dependent on the location of information printed on Part I 100 which is intended to be imparted onto other parts attached underneath. This will be described more fully below.

Part II 200 is formed from a sheet of sixteen pound selectively carbonized bond paper. Part III 300 is formed from a sheet of sixteen pound selectively carbonized bond paper. Part IV 400 is formed from a sheet of twenty-four pound register bond paper, which is similar to carbonized bond with one exception that carbon is not attachable to the register bond paper as readily as with the carbonized bond paper. Part V 500 is formed from a sheet of twenty pound register bond paper, and Part VI 600 is formed from a sheet of twenty pound register bond paper.

Part II 200 and Part VI 600 are attached together to form an outgoing envelope 20 which is readily separable from the other attached parts of system 10 as will be described in detail below. Outgoing envelope 20 encloses Part III 300, Part IV 400, and Part V 500.

Part IV 400 and Part V 500 are attached together to form a reply envelope 30 which is readily separable from the other attached parts of system 10 as will be described in detail below. Part IV 400, being made of thicker and heavier paper, provides significant strength to both the reply envelope 30 and outgoing envelope 20 which assists in preserving postal envelope form system 10 upon encountering processing machinery. Additionally, attaching Parts I–VI by gluing right side edge bolsters the durability of postal envelope form system 10 which typically progress through postal processing machinery with the right edge leading the remainder of the Parts.

FIG. 2 is a block diagram of Part I 100 which forms an originating sheet of the postal envelope form system of the present invention. Part I 100 is the originating sheet upon which a printer prints information. The postal envelope form system 10 was designed for use with a relatively inexpensive impact printer (not shown) having a narrow carriage (e.g., Okidata Microline 320 Turbo). These types of printers are common in the industry due to their low cost and reliability. The information printed by such printers includes billing information identifying the goods or services rendered, the time period covered, mailing information, and postage information, which are discussed further below. Part I and originating sheet will be used interchangeably hereinafter with reference to numeral 100.

FIG. 2 depicts originating sheet 100 as having a colored area 101 among various and white areas that will be discussed individually. Reference is made to originating sheet 100 in conjunction with other parts throughout the remaining discussion.

Specifically, originating sheet 100 includes a sender return address area 102 within which a sender return address is printed before mailing (i.e., preprinted). FIG. 2 also shows in cross-hatching a carbon spot 102*a* located on a back face (not shown) of originating sheet 100. Carbon spot 102*a* enables the force of the impact printer used to impart information onto the sheet immediately below originating sheet 100, which is Part II 200.

Therefore, originating sheet (Part I) 100 is printed with the information that is intended to be printed on sheets beneath it. Thus, originating sheet (Part I) is preprinted with all the information printed on system 10. Originating sheet 100 also includes customer mailing address area 104 within which a customer mail-to address is printed before mailing along with a delivery point barcode discussed further in conjunction with FIG. 3 below. FIG. 2 also depicts in cross-hatching a carbon spot 104*a* that is located on a back face (not shown) of originating sheet 100. Carbon spot 104*a* enables the force of the impact printer used to impart information onto Part II 200, which is the face of outgoing envelope 20.

Originating sheet 100 also includes a postage permit area 106 within which postage permit information is printed before mailing. The postage permit information is that which the post office uses in assigning a postage charge and postage discounts to the sender.

FIG. 2 also depicts in cross-hatching a carbon spot 106*a* that is located on a back face (not shown) of originating sheet 100. Carbon spot 106*a* enables the force of the impact printer used to impart information onto Part II 200, which is the face of outgoing envelope 20.

Originating sheet 100 is approximately five-and-a-half inches tall and nine-and-seven-eighths/inches wide, which fits within narrow carriage impact printers Generally, forms similar to postal envelope form system 10 are approximately nine-and-a-half inches wide. However, system 10 was made one quarter of an inch wider to accommodate areas large enough to include reasonable amounts of information, yet still fit within size dimension standards of the post office.

Since originating sheet 100 includes all the information printed on the various other parts of system 10, originating sheet 100 is useful for keeping records of the sender. Furthermore, originating sheet 100 incorporates a line of weakness or perforation 107 transverse to the width that allows a portion 107*a* to be separated from a portion 107*b*. Portion 107*a* can be used in a business method as a reminder billing statement, while portion 107*b* can still be retained for record keeping purposes. Thus, originating sheet 100 can be used as a reminder bill or a collection bill, with both a customer receipt and a remittance copy.

FIG. 3 is an actual copy of the front face of originating sheet (Part I) 100, and depicts placement of text within the various blocks shown in FIG. 2. Specifically, sender return address area 102, customer mailing address area 104, and postage permit area 106 are shown with text contained therein. Sender return address area 102 has a return address shown, but with the name of the sender removed for confidentiality purposes. The name of the sender is actually printed uppermost in sender return address area 102. Similarly, customer mailing address area 104 and postage permit area 106, have information printed uppermost in the areas 104 and 106. In the case of customer mailing address area 104, the uppermost information is delivery point barcoding 108 that allows certain postage discounts to be credited to the mailer of outgoing envelope 20 upon which the barcoding 108 is transferred. A series of circular cuts 109 are located on each side of system 10, in parallel, to form pin-feed margins that assist printers in feeding forms through a printing path during printing.

FIG. 4 is a block diagram of a front face of Part II, which forms a portion of an outgoing envelope 20 upon which the information in the sender return address area 102, the customer mail-to/address area 104, and postage permit address area 106 are imparted by the impact printer. FIG. 4 depicts a colored area 202 within which white areas 102', 104', and 106' are located. White areas 102', 104', and 106'correspond to the sender return address area 102, the customer Mail-to/address area 104, and postage permit address area 106 of originating sheet (Part I) 100. Note boxes 102', 106' and 104' on FIG. 4 are much larger than their corresponding twin images on FIG. 3. This is necessary to insure scanability.)

The colored areas 202 provide a visual indication that allows outgoing envelopes sent by the same sender to be easily identified with the sender. The colored areas of all parts of system 10 can be kept the same, or varied if desired, to create meaning associated with the colors. For example, all the colored areas of system 10 can be kept the same color to associate various parts being mailed at different times in reply with a particular mass outgoing mailing. Alternatively, various parts can be differently colored to provide an visual indication of which part among system 10 is being seen without having to refer to the contents of the part.

The white areas are purposefully not colored to enable the information printed within to be easily read by users and scanning equipment associated with postal envelope form system 10. The information within the white areas is transferred from Part I 100 to Part II 200 is achieved through the selectively positioned carbon spots 102*a,* 104*a,* and 106*a* located on the back face of Part I 100.

FIG. 4 also depicts carbon areas 204, 206 and 208 which transfer information imparted by the impact printer onto originating sheet (Part I) 100 and through to a billing statement sheet (Part III) 300 (FIG. 5). The information imparted by the impact printer onto originating sheet (Part I) 100 and that is transferred to billing statement sheet (Part III) 300, includes information contained within the sender return address area 102 and within the customer mailing address area 104. The information additionally includes that within a customer return address area 110, a distributor or sender mailing address area 112, a response detail area 114, and a message area 116.

The information contained within customer return address area 110 is transferred by carbon spot 204 to billing statement (Part III) 300 within a customer return address area 310 shown in FIG. 5. FIG. 5 is a block diagram of a front face of Part III, which forms a billing statement of the postal envelope form system of the present invention, and depicts colored areas 350 among which white areas such as customer return address area 310 are located. Other white areas located among colored areas 350 include a sender return address area 302, a customer mailing address area 304, a sender mailing address area 312, a response detail area 314, and a message area 316. The same information imparted to originating sheet (Part I) is imparted to billing statement (Part III) 300, with the exception of the postage permit 106 and a face identification mark (FIM) discussed below. Thus, billing statement (Part III) 300 contains complete information.

FIG. 5. additionally includes directions 320 that in the embodiment shown instruct the recipient of billing statement (Part III) 300 to "Please return this portion with your response. Thank You!". The portion requested for return is a remittance copy 360, which is separated by a line of weakness (perforation line) 362 from a customer copy 364. Thus, a business method is established by which a customer can retain customer copy 364 as a courtesy when the customer returns the remittance copy 360 with payment or payment information in reply to receiving billing statement (Part III) 300.

FIG. 6 is a block diagram of the back face of billing statement (Part III) 300 shown in FIG. 5. FIG. 6 depicts a front view of this back face billing statement (Part III) 300, and shows carbon spots in patterned cross-hatching among a colored area 401. The carbon spots in FIG. 6 are selectively positioned to correspond to the location of information imparted by the impact printer on originating sheet (Part I) 100 and to be transferred to similarly positioned areas on reply envelope 30 shown in FIG. 7.

Originating sheet (Part I) 100 further includes a face identification mark (FIM) area 140 that corresponds to a carbon spot 640 in FIG. 6. It should be noted that FIG. 6 is a back view of billing statement (Part III) 300, and is therefore a mirror image of the positioning of FIM area 140. Similarly, FIG. 6 includes a distributor mailing address area 612 which is a mirror image of the positioning of distributor mailing address area 112 shown in originating sheet (Part I) 10 (FIGS. 2 and 3). The distributor mailing address area 612 is a carbon spot that imparts the address information of the sender of the outgoing envelope shown in FIG. 7. FIG. 6 also includes a carbon spot 610 that corresponds in mirror image to customer return address area 110 shown in FIGS. 2 and 3.

FIG. 7 is a block diagram of a front face of Part IV, which forms a portion (the front sheet) of reply envelope 30 of the postal envelope form system of the present invention. FIG. 7 depicts colored area 701, and white areas which are a mirror image of carbon spots shown in FIG. 6. Specifically, FIG. 7 shows a customer return address area 710, a distributor mailing address area 712, and a FIM mark 740 as white areas. Note boxes 710, 712 and 740 on FIG. 7 are much larger than their twin image on FIG. 3. This is necessary to ensure scanability. The white area provides high contrast with the information contained therein which was imparted by the carbon spots 610, 612, and 640 shown in FIG. 6. FIG. 7 is a front view of reply envelope 30 and therefore the positions of areas 710, 712, and 740 match with the positions of areas 110, 112, and 140 shown in FIG. 1; whereas the areas 610, 612, and 640 of FIG. 6 are mirror imaged in comparison because FIG. 6 is a back view.

FIG. 7 also includes direction area 750 which in this embodiment instruct the user of reply envelope 30 to "PLACE STAMP HERE The Post Office will not deliver mail without Postage." The postage placed at or near direction area 750 is cancelled by post office processing equipment. The inclusion of FIM 740 and a delivery point barcode in address area 712 on reply envelope 30 allows the user of postal envelope form system 10 to qualify for additional postage. discounts credited upon payment for mailing outgoing envelope 20, as long as other criteria are met. The other criteria include a threshold readability or accuracy level above which a percentage of the mailings sent by users must surpass. In the year 2000, 90% postal barcoding contained in mail-to address areas such as address area 712 must be scannable by postal processing equipment. If the 90% threshold is not meet, the discounts on postage are not given. These discounts can be approximately six cents per envelope which is quite significant when using business mailers to solicit payment for goods or services rendered from a very large number of customers.

FIG. 8 is a block diagram of a back face of Part IV, which forms the same portion of the reply envelope shown in mirror image of FIG. 7. FIG. 8 depicts security screened areas 802, and shows block-out areas in solid dark blocks 810, 812 and 840 which correspond to areas 710, 712 and 740 in FIG. 7. The security screened area 802 prevents information contained within reply envelope 30 from being either read or scanned through the paper of envelope 30. Dark blocks 810, 812 and 840 enhanced the scanability of the reply envelope address data in white block's 710, 740 and 712. Blocks 810, 812 and 840 prevents any image of envelope contents or security pattern from showing through the front of the reply envelope. This prevents information contained in the reply envelope under the areas of 710, 712 and 740 from being mistakenly scanned by postal processing equipment attempting to scan reply envelope 30. It has been found that printing only the security screen without dark blocks 810, 812, and 840, caused errors in scanning. Scanning errors were reducing the accuracy rate required to qualify for the best postage discounts. However by printing the dark blocks 810, 812 and 840 the greatly improved to scan accuracy to well above the 90% requirement.

FIG. 8 also depicts a flap 880, formed by line of weakness 885 and edge 886, upon which moistenable glue is placed. Flap 880 can contain parallel lines of glue to better ensure that envelope 30 seals properly. Flap 880 also serves as a direction area The directions in this embodiment instruct the user to "MOISTEN THIS FLAP, THEN FOLD FLAP OVER TO SEAL." Flap 880 folds about line 885 and attaches to the other portion of envelope 30 formed by Part V 500. The directions in this embodiment also instruct the user to "Pull To Remove Contents." The removal instruction is for separating the reply envelope 30 (Parts IV and V) and billing statement 300 (Part III) from outgoing envelope 20. The separation is achieved in part due to lines of weakness formed before the various Parts I–VI are attached together. Specifically, line of weakness 883 is a perforation that allows easy separation by simply pulling reply envelope 30 (Parts IV and V) and billing statement 300 (Part III) from outgoing envelope 20. Line of weakness 883 once completely weakened form the boundary of reply envelope 30 along with an edge 886.

FIG. 9 is a block diagram of a front face Part V of the back of reply envelope 30. FIG. 9 depicts a security screened area 900 that prevents sensitive information contained within reply envelope 30 from being easily read through the sometimes transparent sheets of paper forming the various Parts of postal envelope form system 10. An edge 902 is attached, such as by glue, to a correspond edge on the back of Part IV 400 shown in FIG. 8. An edge 904 is left unattached so that an opening is formed in reply envelope 30.

FIG. 10 is a block diagram of a back face of Part V, which is the outside of the other portion forming reply envelope 30. FIG. 10 depicts colored area 1002 and printed direction area 1004. A flap 1006 formed by a line of weakness 1008 and an edge 1010 is glued to a front face of Part VI 600 so that when a tab of Part VI 600 is removed, flap 1006 is removed along with it. In the event that flap 1006 is not removed as intended, instructions reading "REMOVE" clearly tell the user what to do. The gummed flap referred to is that flap 880 mentioned above in conjunction with FIG. 8.

FIG. 11 is a block diagram of a back face of Part VI, which is the outside of the other portion of outgoing envelope 20 shown in FIG. 4. FIG. 11 depicts a colored area 1102, a direction area 1104 and a fast pull tab 1111 for opening the outgoing envelope 20. Direction area 1104 instruct the recipient of outgoing envelope 20 how to operate fast pull tab 1111: "TO OPEN—LIFT TAB AND SLOWLY PULL TO YOUR RIGHT." Tab 1111 includes an unattached portion 1112 which can be lifted easily to grasp and pull tab 1111 at a line of weakness 1114. Although the instructions indicate that the user is to pull to their right, the tab is located on the bottom (and printed upside down) relative to the orientation of the writing on the front faces of outgoing envelope 20 and reply envelope 30.

This location and orientation of tab 1111 is significant in many respects. The location of tab 1111 on the bottom and back of outgoing envelope 30 (as oriented by the writing on envelopes 20 and 30) allows the return address areas of envelopes 20 and 30 to be positioned at the uppermost edge since there is no interference with a conventionally placed folding closure flap. In other words, in conventional envelopes, the closure flap is placed at the top which would force the return address to be positioned only as high as the folding line. In the present invention, the position, location and orientation of tab 1111 does not force the return address of the outgoing envelope to be lowered. This allows a greater amount of information to be imaged on the various parts of postal envelope form system 10.

Furthermore, tab 1111 is constructed with unattached portion 1112 and perforation 1114 to reduce damage by the U.S. Postal Service equipment to the contents of outgoing envelope 20 such as ripping or tearing the billing statement (Part III) 300 or reply envelope 30.

Similarly, reply envelope 30 has flap 880 located at the bottom which allows the return address area 710 (FIG. 7) to be positioned uppermost (within certain tolerances) on reply envelope 30. This allows a greater area for message areas 116 (FIGS. 2 and 3), message area 316 (FIG. 5), and response detail areas 114 and 314.

Having fully described postal envelope form system 10 above, a few additional points should be made to elaborate on how system 10 came to be developed to provide certain advantages and meet various needs identified in the industry. First, narrow carriage impact printers have limitations that the design had to overcome, one being the maximum width of the form being ten inches. Second, the striking force of impact printer's print head limits the number and weight paper being used. Third, the print speed of narrow carriage printers is slow compared to other options.

The design of the present invention overcomes these limitations. The form is kept as small as possible to limit wasted motion of the print head, to fit within narrow carriage impact printers, to fit size dimension standards of the post office, and to weigh approximately less than one ounce. Managing the strike force of the impact printer head was achieved by the combination of paper weights and characteristics. This management proved to be vital when addressing both narrow carriage printer capabilities and postal requirements.

Designing system 10 on a small format that provides complete information to both the businesses and their customer was very challenging. Yet, system 10 provides complete return address and mail-to address information on both the outgoing and the business reply envelopes 20 and 30. The billing statement (Part III) 300 has a vertical perforation that separates the sheet into remittance copy 360 and customer copy 364, both of which have complete information due to the careful positioning of areas throughout the various parts. The information on both portions includes: (1) name and address of sender; (2) name and address of customer; (3) detailed information on the customer copy; (4) response information on the billing statement; (5) account numbers on both portions; (6) postal barcoding on each envelope; and (7) the FIM mark on the reply envelope.

System 10 is very flexible in that it allows postage indicia to be printed thereon, or a stamp or metered postage to be used. FIM marks are not required on all mail, and system 10 allows FIM mark to be imaged or not imaged. When used, FIM marks have been tested in postal processing equipment and achieved a 99.9% readability rate. System 10 also allows postal barcoding to be printed when desired.

Furthermore, postal endorsements are required periodically and several options are available to post office customers. These endorsements come with various costs charges by the post office and each one has differing verbiage. The post office requires use of such endorsements once every six months, however, postal customers using system 10 can use the endorsements monthly if they choose. Complete freedom of which endorsement is used, how frequently it is used, or use of a different endorsement on each mailing is possible using system 10. Additional flexibility is provided by choosing which color system 10 will be.

Contrast is an important element of being able to read the address and postal barcoding on the envelopes by the post office scanning equipment. System 10 takes advantage of this by focussing the scanner's attention to the vital data area These areas are the mail-to address, return address, the FIM mark, and postage permit area. These areas are white only, or other highly contrasting combinations of colored area and colored information therein. The boxes that form these focal areas allow $1/10^{th}$ of an inch free space around the data image area. The post office standards require $1/25^{th}$ of an inch free space around all scannable data. Thus, system 10 exceeds these requirements. This is seen in originating sheet 100 where the colored portions are located between addresses 102 and 110, between areas 114 and 116, 112 and 104 and between postage permit 106 and area 114. The balance of the surface is printed in an ink color which causes reduced contrast. The post office scanners find the data in the high contrast areas.

Locating the postal barcoding in the mail-to address areas in envelopes 20 and 30 is also very important. In a main embodiment, the barcode must be the first line printed, and is located at the very top of the address box as seen in FIG. 3 in areas 104 and 112. This moves the barcode up and out of the way of the post office handling equipment that is most viscous to the area which otherwise smudges the barcode. The positioning shown in FIG. 3 improved readability of the barcode from 60% to 98% after six passes through the postal equipment. The business reply envelope address is located above the outgoing address area which protects the barcode and address information therein from similar damage. The reading results of the business reply envelope is 95% after going through the postal equipment 12 times.

Another important feature of system 10 is the block-out patterns which are printed on the inside of the envelopes. This prevents data or information contained within the envelope from being scanned and interfering with barcodes or address lines. The fine screened box of system 10 appears to be solid to scanners, so there is no mistaking a pattern as information.

The positioning of tab 1111 on the bottom backside of the envelope is also very important to the success of system 10. First, locating tab 1111 on the bottom of the envelope 30 permits variable information to be imaged to the very top of the form. This allow the complete form design to be moved up to the very top of the envelope. The top is the ideal position for the return address information for the outgoing and reply envelopes 20 and 30, FIM 740, and postal indicia 106. This change allows the postal barcode to be moved up out of the way of the post office equipment in order to limit damage and smearing to improve readability.

Orientation of tab 1111 was also very important to damage control resulting from post office processing equipment. Tab 1111 is best located behind the left side of the face of the envelope 20; in other words, on the right side facing the back of envelope 20. This orientation prevents the tab 1111 from accidentally being snagged and opened while traveling through the postal equipment.

Crumple damage control of the right vertical edge of system 10 is also important. Post office equipment has a catch or bar stop that blocks the envelope path when the envelope hits the stop. The impact of envelopes 20 and/or 30 against the catch can cause crumple damage to the mail piece. This damage can lead to the ordinary mailers being further damaged or destroyed by postal handling equipment. System 10 reinforces the right edge 40 to minimize crumple damage.

Lastly, the paper weights and characteristics have been selected very carefully after much research and experimentation. The combination described herein yields durability and strength, while allowing imaging through all parts. Other paper weight combinations can be used, as various other combinations have been tested. However, the combination of types and characteristics provided herein represent the best mode known to date.

In summary, system 10 provides readable by postal scanners of barcode and address information on both outgoing and reply envelopes higher than the requirement established by the year 2000 goal of 90% accuracy. Solid blocks such as found blocks 840, 810 and 812 can also be applied to standard envelopes (e.g., only a single envelope not necessarily contained in a system) to improve postal scanning of alpha numeric address information. System 10 provides an ergonomic design of forms, which reduces injury to users hands and arms from repetitive manual bursting. This is accomplished this by weakening the pinfeed and between form perforations by using perforation that have wider cuts and narrower ties between perforations. This weak perforation requirement for the purpose of protecting the health of the user and the employees has never been accomplished before.

System 10 is extremely flexible and user friendly. For instance customers can change addresses without concern of form cost.

System 10 establishes focal points on both outgoing and reply envelopes in the form of white boxes which contain the variable data in the form of to and from addresses, delivery point barcodes and FIM mark. These focal points helps the postal equipment to find, read and sort with a very high degree of accuracy approaching 100%. Managing printer impact on system 10 to achieve a scan accuracy of almost 100% required careful selection of paper weights. The fundamentals of this invention can be applied to an unlimited array of form requirements and sizes. This system is very flexible. While this invention has been described in connection with what is presently considered to be most practical and preferred embodiments, it is to be understood that the invention is not limited to the disclosed embodiments, but, on the contrary, is intended to cover various modifications and :equivalent arrangements included within the spirit and scope of the appended claims. For example, fewer than six parts could be used while still imparting substantially the same information on the number of parts actually used. Additionally, another embodiment of the present invention would replace the originating sheet with an electronically stored version of the information contained on the originating sheet, thereby allowing fewer than six parts to be used. Furthermore, it is envisioned that equivalents of the specific paper types and weights combinations could be readily used to achieve transfer of information through the number of parts used in an embodiment. Alternatively, when greater than six parts are used, adjustment of part weights and types are necessary to image through the parts, depending on printer strike force. Similarly, improvements in either impact printers and/or postal processing equipment in use may bring about equivalent embodiments, as long as the printer used is able to legibly impart the information that is readable/scannable by the postal processing equipment.

The tab 1111 of FIG. 11 has at its right end a tab portion 1111*a* which the person who has received the outgoing envelope in the mail holds between his or her thumb and forefinger. The tab portion 1111*a* is, however, in the prior art, in close contact with area 370 and flap 880 of the Billing Statement and reply envelope (see FIGS. 5 and 8). An inexperienced person, in the absence of the present invention, might grab both the tab portion 1111*a,* 370 and 880 and then pull on them thus causing serious damage to the reply envelope and billing statement.

With the present invention, the problem described above is overcome. Instead of the back-side 701 (FIG. 7) of the reply envelope and the front side of FIG. 5 area 370 lower left corner being a complete rectangle (as it is shown in my aforesaid prior application Ser. No. 09/328,417), it has two triangular portions 370, 770 and 775 of it removed as shown in FIGS. 5 and 7. This removes the parts of the reply envelope, and of the billing statement, that may be grabbed accidentally by the inexperienced person, and solves the problem.

FIG. 12 shows a prior art outgoing return envelope. The outgoing envelope 1205 has a tab 1208 having a portion 1209 which is adapted to be pinched, held or grasped by a human hand (finger and thumb). After the tab portion 1209 is tightly held by a hand it is pulled to open the envelope 1205. However, the upper left hand corner 1210 of a billing statement and/or of a flap on the return envelope is available. Since the corner 1210 may curl or be only loosely against whatever is under it, it may easily be mistakenly grasped by a person attempting to get his or her finger and thumb in pinching position on the tab portion 1209. As a result the billing statement and/or flap, as the case may be, may be damaged or ruined when a person pulls the tab portion 1209 to remove the tab 1208.

FIG. 13 shows one way that this invention overcomes the problem described in connection with FIG. 12. Although my invention has the tab 1311 adjacent to and extending along the lower longitudinal edge of the back side of the outgoing envelope 1305, it is also applicable to tabs along the top of the envelope as shown in FIG. 12.

In FIG. 13, the billing statement 1307 does not have the usual lower right hand corner, but there is a die cut along line 1307*a*. Similarly, the flap (that is used to close an envelope) of the reply envelope has a die cut along line 1307*b*. As a result, the pointed corners of the billing statement and the reply envelope have been cut off.

The billing statement and reply envelope of FIG. 13 are far less likely to be damaged than the ones shown in FIG. 12, since the corner is replaced by a slanted line. The lower right parts of the billing statement and of the flap of the reply envelope of FIG. 13 are much more likely to lie flat than the corners of those components as shown in FIG. 12.

FIG. 14 shows a modified form of my invention wherein billing statement 1407*a* and flap 1407*b* (of the return envelope) have been cut back even more than was done in FIG. 13, so that those parts do not even extend under the tab portion (which is held or pinched) at all.

FIG. 15 is a further modified form in which the billing statement 1507*a* and reply envelope 1504*b* remain as full rectangles, but the tab portion 1509 of tab 1511 has been moved so far to the left that the corners 1510 of the flap of the return envelope and of the billing statement are out of the paths of a finger and thumb moving into a position where they will pinch the tab portion 1509.

I claim to have invented:

1. A postal envelope system, comprising:

an outgoing envelope having a front side and a pocket, said outgoing envelope having a tear strip which may be pinched and pulled to open said outgoing envelope, said tear strip having a face, longitudinal edges and terminating in an end, a sheet of material in said pocket, said sheet having a portion thereof that has a face that is contiguous with said face of said tear strip, said portion comprising means, having an edge that is at an acute angle to a longitudinal edge of said tear strip, for reducing the possibility that said sheet will be pinched and pulled when said tear strip is pinched and pulled to open the outgoing envelope.

2. A postal envelope system as defined in claim 1, in which said outgoing envelope has a lower back side and in which said sheet has a lower end, and in which said portion of said sheet is adjacent said lower back side of said outgoing envelope.

3. A postal envelope system as defined in claim 2, in which said sheet is a billing statement.

4. A postal envelope system as defined in claim 2, in which said sheet is part of a return envelope.

5. A postal envelope system as defined in claim 4, in which said part includes a flap on said return envelope.

6. A postal envelope system as defined in claim 1, in which said sheet is a billing statement.

7. A postal envelope system as defined in claim 1, in which said sheet is a part of a return envelope.

8. A postal envelope system as defined in claim 7, in which said part includes a flap on said return envelope.

9. A postal envelope system as defined in claim 1, in which said angle is 45 degrees.

10. A postal envelope system, comprising:

an outgoing envelope having a pocket, a front side, top and bottom edges and left and right end edges, said outgoing envelope having a tear strip extending adjacent to, as well as parallel to, one of said edges, said tear strip terminating in an end which when pinched and pulled opens the pocket of said outgoing envelope, said tear strip having a first portion thereof which includes most of the length of said strip and a second portion thereof adjacent said end of said tear strip, a return envelope located in said pocket of said outgoing envelope, said return envelope having a flap which, when the outgoing envelope is held in a position in which said front side is horizontal and facing downwardly, extends parallel to and under said first portion of said tear strip; said flap having a portion thereof cut-away and which would have been contiguous with said second portion of said tear strip if it had not been cut-away, said second portion of said flap comprising means, for reducing the possibility that said flap will be pinched and pulled when the outgoing envelope is opened by pinching and pulling said tear strip.

11. A postal envelope system as defined in claim 10, in which said cut-away portion is triangular in shape.

12. A postal envelope system, comprising:

an outgoing envelope having a pocket, said outgoing envelope having front and rear faces, a sheet of paper, positioned in said pocket, and having right and left ends each of which terminates in an edge, said sheet having a face, said outgoing envelope including a tear strip having one end which if pinched and pulled will open said outgoing envelope, said tear strip having longitudinal edges, said tear strip, having a face that is contiguous with said face of said sheet, said sheet having a portion thereof cut-away so that said sheet constitutes means for reducing the possibility that said sheet will be torn when said tear strip is pinched and pulled, said cut-away portion would have been at least partly contiguous with and adjacent to said one end if said cut-away portion had remained a part of said sheet.

13. A postal envelope system as defined in claim 12, in which said cut-away portion is triangular in shape.

14. A postal envelope system as defined in claim 12, in which said sheet is a billing statement.

15. A postal envelope system as defined in claim 12, in which said sheet is part of a return envelope.

16. A postal envelope system as defined in claim 15, in which said part includes a flap of said return envelope.

* * * * *